US006578990B2

(12) United States Patent
Hildenbrand et al.

(10) Patent No.: US 6,578,990 B2
(45) Date of Patent: Jun. 17, 2003

(54) LUMINAIRE

(75) Inventors: Volker Dirk Hildenbrand, Eindhoven (NL); Claudia Mutter, Eindhoven (NL); Wanda Susanne Kruijt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/078,934

(22) Filed: Feb. 19, 2002

(65) Prior Publication Data

US 2002/0159261 A1 Oct. 31, 2002

(30) Foreign Application Priority Data

Feb. 21, 2001 (EP) ..... 01200618

(51) Int. Cl.[7] ..... F21V 7/22

(52) U.S. Cl. ..... 362/341; 362/317; 362/307; 359/599; 313/635

(58) Field of Search ..... 362/231, 240, 362/241, 300, 84, 341, 317; 359/599; 428/403, 402; 313/635, 113

(56) References Cited

FOREIGN PATENT DOCUMENTS

| | | | |
|---|---|---|---|
| EP | 0460913 A2 | * | 12/1991 |
| EP | 0617092 A2 | * | 9/1994 |
| EP | 0971246 A1 | * | 1/2000 |
| JP | 409061554 A | * | 3/1997 |

* cited by examiner

*Primary Examiner*—Sandra O'Shea
*Assistant Examiner*—Hargobind S. Sawhney

(57) ABSTRACT

The invention relates to a luminaire (1) comprising a reflector body (9) having a reflecting part (2) provided with a light reflective coating (5), and comprising contact means (6) for electrically connecting a light source. The coating (5) comprises at least two, light reflective particle groups, the groups exhibiting a mutually different color because of an interference layer (12*a–d*) provided on the particles (10*a–d*) which is different for the respective groups. A white color impression of the coating (5) is obtainable when the groups are jointly used in relative proportions in the coating (5). The coating (5) does not suffer from intrinsic absorption, or from color shift.

13 Claims, 3 Drawing Sheets

LUMINAIRE

The invention relates to a luminaire comprising:

a reflector body having a reflective part provided with a coating, the coating in which exists at least a first and a second interference layer, the layers being mutually different, the coating further comprising at least one material selected from a set consisting of materials with a high-index of refraction and at least one further material selected from a further set consisting of materials with a low-index of refraction;

contact means for electrically connecting a light source.

Such a luminaire is known from U.S. Pat. No. 3,644,730. In the known luminaire the coating is light reflecting and comprises two or more interference layers of one-quarter wavelength each, the layers are alternatively of high- and low-index material. By choosing the number of layers, their index of refraction and their respective thickness the coating can be given particular desired optical properties. The optical properties of the coating are based on interference of light, the material of the interference layers being partly transparent for light. The interference is used to selectively influence wavelength dependence of reflection and transmission of the coating. It is thus enabled for the coating to be selectively reflective, for example, to be transparent for IR-radiation whilst being reflective for visible radiation. It is a disadvantage that the manufacturing of the reflective coating is cumbersome since for the coating to appear white, i.e. the coating being essentially total reflective for all wavelengths of the visual spectrum, a large number of alternate layers of high- and low-index materials is required. The manufacturing is even more cumbersome as it is difficult to apply the coating on the curved/shaped surface of the reflecting part of the luminaire. Alternatively, when a coating step is done before a shaping step, the manufacturing is even so cumbersome as the shaping of the pre-coated reflector involves significant risk of damage to the coating.

In a backlighting system the light reflecting coating might simultaneously act as a coating for a diffusor, i.e. due to scattering by the coating light passing through the diffusor is diffused. For example titanium dioxide particle coatings are generally known for that purpose. For such scattering of light to occur effectively, the coating should comprise particles having a size in the order of the wavelengths to be scattered, i.e. in the range of less than 1 $\mu$m. However, conventional coatings of essentially white particles of the indicated size, for example generally known titanium dioxide, suffer from color shift due to wavelength dependent scattering.

It is an object of the invention to provide a luminaire of the kind as described in the opening paragraph in which the abovementioned disadvantages are counteracted.

In accordance with the invention the luminaire of the type as described in the opening paragraph is characterized in that the coating comprises at least a first and a second light reflective particle group, the first interference layer being provided on particles of the first particle group, and the second interference layer being provided on particles of the second particle group, for each light reflective particle group, the particles of that particle group consist of a material selected from one of said sets, and the respective interference layer consists of a material selected from the other of said sets, at least one material in each respective light reflective particle group is selected to be different in composition or layer thickness from materials of any other particle group, and relative quantities of each respective light reflective particle group are chosen such that, when their reflections are blended, white light of predetermined CIE coordinates is produced.

A generally known method for obtaining white light by blending relative spectral proportions is described in Van Nostrand's Scientific Encyclopedia by Douglas M. Considine, Van Nostrand Reinhold Company, New York (1976), $5^{th}$ edition. In U.S. Pat. No. 4,434,010 a method to manufacture particles with an interference layer is disclosed. Particles with an interference layer are commercially available, for example under the trade name Iriodin/Afflair, and exhibit pearlescence, i.e. the particles have a milky brightness. The color of the pearlescent particles is due to the interference of light, i.e. interference of a part of the visible spectrum. In comparison thereto, conventional pigments absorb a part of the visible spectrum, while luminescent materials emit a part of the visible spectrum. The mutually different color of the interference (or pearlescent) pigments and thus of the particle groups is due to the interference layers being mutually different. For example, the interference layers of the first particle group with respect to the second one can differ either in layer thickness or in index of refraction, for example in that they are made of different materials. The particles preferably have a relatively large size, i.e. >=5 $\mu$m, and for that reason wavelength dependent scattering and hence color shift is counteracted. In the coating applied in the inventive luminaire, the particles in general have a relatively random orientation compared to the orientation of a layer on the shaped surface of the reflecting part of the known luminaire. It is generally known that the reflectance and color appearance of an interference layer is dependent on the wavelength and the angle of incidence of light. However, it was observed that the coating in the luminaire of the invention exhibits less dependency both on the incident angle of light and on the view angle on the coating. This can be explained by the relatively random orientation of the particles, and thus of the interference layer provided thereon, or the use of the blend of the different particle groups wherein a coloring effect of one particle group is more or less compensated for by another particle group. Preferably each particle within one of the particle groups is provided with the respective interference layer, and so further improving the independency of incident angle of light and view angle with respect to the color appearance. When the coating comprises at least two groups of mutual differently colored particle groups in appropriate relative proportions, it is possible to effectively counteract that the coating exhibits a particular color. Surprisingly, it appeared that the colors of the particle groups don't behave as subtractive colors as is the case for pigments, i.e. the combination of colors leads to darker/black colors. On the contrary, the colors of the particle groups behave as additive colors as is the case for luminescent materials, i.e. the combination of colors lead to whiter colors. Thus a coating which appears white for the human eye is obtainable. Such a white coating is especially well obtainable when in the coating the particles of said particle groups are mixed instead of being stacked as separate layers on each other. Coatings consisting of particles are relatively easily applied, for example by spraying, onto the reflector body, thus enabling the relatively easy manufacture of the luminaire having a white coating. It appeared that the coating of pearlescent particles has a relatively high reflection and that the interference layer is practically fully transparent for light. As a result, said coating has the advantage that larger numbers of reflections inside the coating and/or variations in thickness in the coating do not lead to significant light loss or to a color shift. Such light loss and/or said color shift, however, can be observed by conventional white powder coatings with optimized scattering power, such as, for example, a coating comprising titanium dioxide particles.

When a combination of two particle groups is used in the coating, the choice of the first particle group is determined in relation with the second particle group. The particle groups each have respective color coordinates in the CIE x,y-chromaticity diagram. A line drawn in the CIE x,y-chromaticity diagram between the color coordinates of the respective particle groups crosses an area of color coordinates of light which has a white appearance to the human eye, i.e. the white color area. In said coating the relative quantities of the two particle groups are chosen in proportion to the length of the section of the drawn line from the respective color coordinates to the white color area, so that when their reflections are blended, there is produced light with color coordinates of light that has a white appearance to the human eye. A generally known method for obtaining white light by blending relative spectral proportions is described in Van Nostrand's Scientific Encyclopedia by Douglas M. Considine, Van Nostrand Reinhold Company, New York (1976), $5^{th}$ edition. A favorable combination of two particle groups is, for example, a blue colored particle group with a gold colored particle group, as in this case in the white color area the drawn line between the color coordinates of the respective particle groups in this case runs substantially parallel to the black body line. This offers the advantage that the relative quantities of the two particle groups can be varied over a relatively wide range whilst a white color appearance is still obtainable. This combination of two groups enables in a relatively simple way the manufacture of a coating which appears white for the human eye. When three particle groups are used in the coating, the particle groups are chosen such, that the triangle formed by the color coordinates of the particle groups in the CIE x,y-chromaticity diagram encloses the white color area. The same reasoning goes for a coating comprising four or more particle groups. A favorable combination of three particle groups is, for example, a blue colored particle group with a green colored particle group and a red colored particle group. The combination of these three groups enables relatively easy to obtain a coating with a specific white color impression and/or makes an even wider range of coatings with a different white color obtainable than is obtainable with two particle groups.

In another embodiment of the luminaire according to the invention the coating comprises four or five particle groups, the coating is particularly suitable for luminaires in which a relatively large number of reflections of light occur, for example in a backlighting system. In such backlighting systems often a diffusor is provided with a coating purposely having a variation in thickness to diffuse the light originating from the light source, which light subsequently is used to homogeneously illuminate a screen. In the event that the reflection of the coating is dependent on the wavelength of the visible spectrum, each reflection results in a color shift, as one part of the spectrum is reflected more efficiently than another part of the spectrum. When only a small number of reflections are involved, said color shift often is not distinguishable by an observer. However, when a relatively large number of reflections are involved, as is often the case in a backlighting system, the color shift is enhanced and might become visible. The visibility of the color shift is enhanced when areas of the diffusor with color shift and areas without color shift are adjacent (or border) each other. By the number of groups in the coating being four or five, it is possible to give the coating a reflection that is practically constant for the visible range of the spectrum, enabling color shift due to thickness variation of the coating to be reduced to an acceptable low level. Furthermore the number of groups being four or five in the coating, renders the coating to be less sensible for local inhomogeneities which otherwise may lead to color differences exhibited by the coating. Moreover it is easier to obtain the white appearance of the coating as the white appearance of the coating is less sensible to fluctuations in composition of the coating and layer thickness variations of the interference layer on the particles. From experiments it was apparent that the respective particle groups exhibiting respectively a blue, green, red, gold and platinum-gold color, are in particular suitable to obtain the desired, homogeneous white appearance of the coating.

The luminaire according to the invention is in particular suitable as a back-lighting system, for example in a liquid crystal display (LCD) system. In back-lighting systems a large number of multiple reflections are required to obtain a homogeneous distribution of light which light subsequently is to be supplied to the LCD. In conventional systems said large number of multiple reflections leads to effects of relatively large light losses and/or to color shifts, said effects being counteracted by the luminaire according to the invention comprising said interference coating.

An embodiment of the luminaire of the invention will be further elucidated schematically in the drawing, in which FIG. 1 is a schematic view of a luminaire according to the invention;

Figure 1:
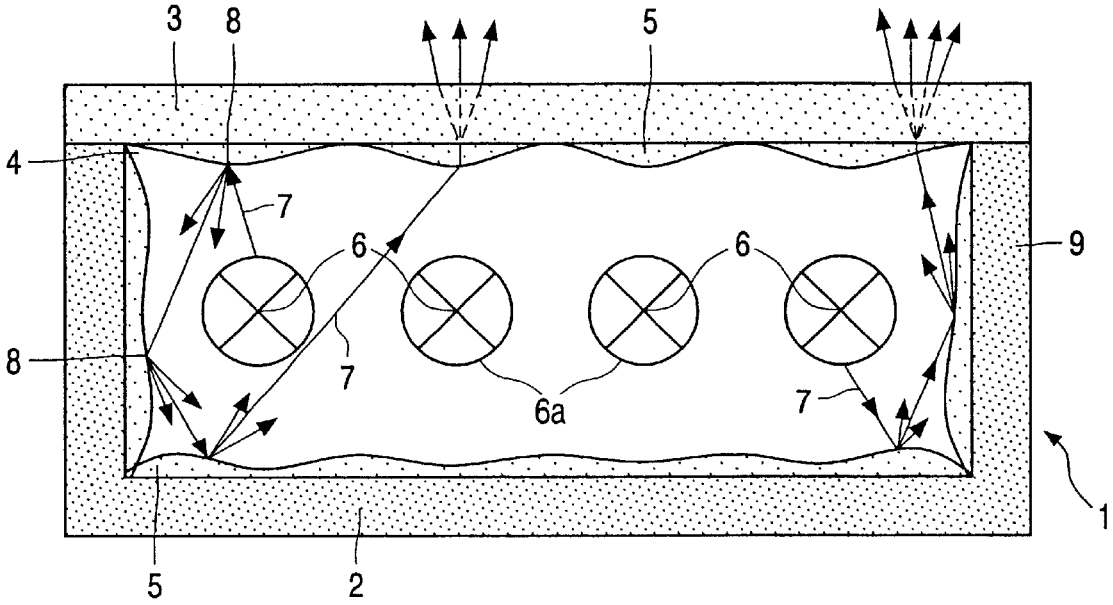

FIG. 1 shows a luminaire 1 for a backlight system in cross-section. The luminaire 1 has a reflector body 9 with a reflective part 2 and a diffusor part 3 which is positioned in front of a light emission window 4 of the luminaire 1. The reflective part 2 and the diffusor part 3 are both coated with a coating 5, but the coating 5 may alternatively be provided solely on the reflective part 2. In FIG. 1 the luminaire 1 is provided with contact means 6. In FIG. 1 four tubular low-pressure mercury discharge fluorescent lamps **6*a* are accommodated in the contact means 6, for example PLS 11W. The lamps 6*a* are positioned in a longitudinal direction perpendicular to the plane of the drawing and along the light emission window 4. During operation of the lamps 6*a*, light beams 7 originating from the lamps 6*a* fall upon the coating 5 and are either reflected by the coating 5 or transmitted through the coating 5 and the diffusor 3. At each reflection 8 of the light beams 7 at the coating 5 some scattering of the light beams 7 occurs, eventually resulting in a homogeneous distribution of light. Finally upon transmission of the light beams 7 through the diffusor 3 a final scattering of the light beams 7 takes place. As a result an object is illuminated homogeneously by the luminaire 1**.

Figure 2:
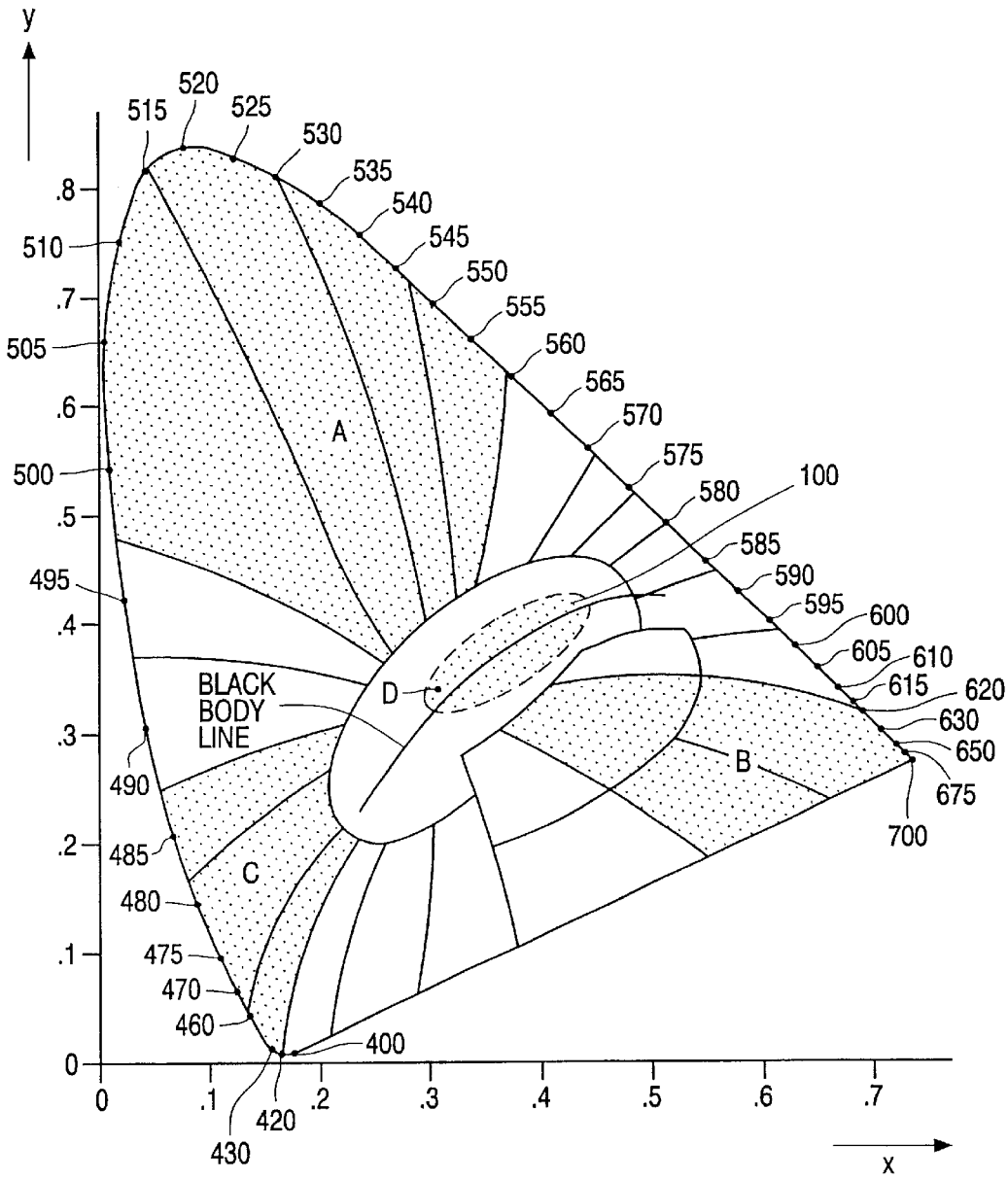
FIG. 2 illustrates the x,y-chromaticity diagram of the CIE system.

In FIG. 2 is shown the CIELAB x, y-chromaticity diagram as defined by the CIE system and superimposed thereon are the various colors A, B, and C shown as letters which indicate areas of the color coordinates of present pearlescent powders. The CIE illuminant D is also shown and represents the color of natural daylight. As a general rule, any color which falls within an area 100 enclosed by the dashed line, i.e. the white color area, will have a white appearance to the human eye. Considering the present invention more specifically in the case of a coating comprising three pearlescent reflective particle groups, i.e. Iriodin 231 (green), 211 (red), and 221 (blue). The first light-reflective particle group, when illuminated, exhibits a green to yellow-green reflection located substantially in area A in FIG. 2. A second of the remaining reflective particle groups, when illuminated, generates an orange to red reflection located substantially in area B in FIG. 2. The third of the light reflective particle groups, when illuminated, reflects purplish-blue to greenish-blue, located primarily in area C in FIG. 2. Upon a combination of relative proportions of said reflective particle groups being chosen such, that when their reflections are blended, there is produced white light of predetermined CIE coordinates, i.e. the coordinates of the produced light lie within the white color area 100 enclosed by the dashed line, for example at point D.

Figure 3:
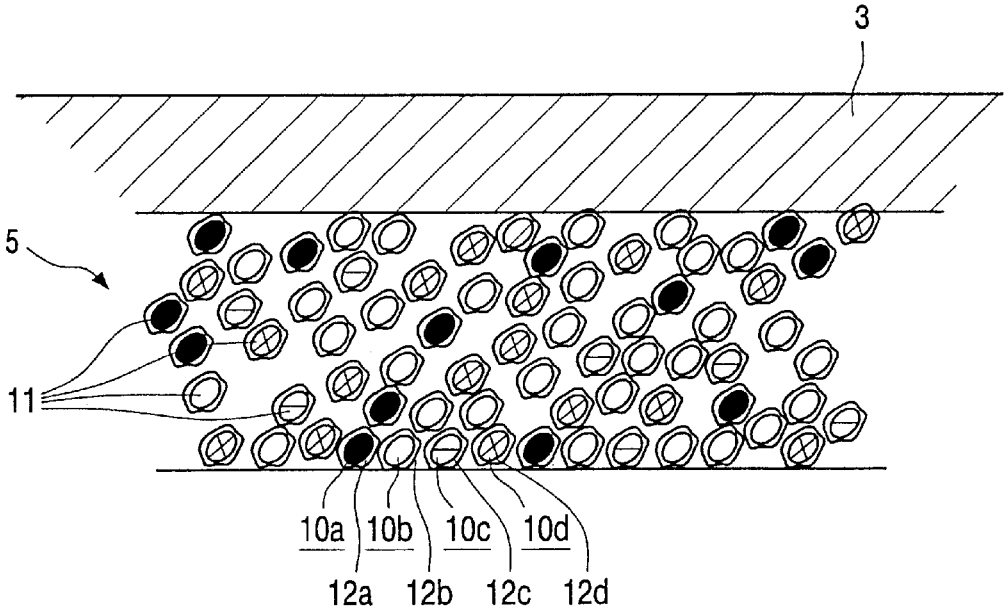
FIG. 3 is a detail of a coating for a luminaire according to the invention.

FIG. 3 shows a detail of the coating 5 of the luminaire of FIG. 1 in cross-section. The coating 5 comprises four mixed particle groups of mutually differently colored particles 10*a–d*. All particles have a core 11 of a low index material, for example mica, and an interference layers 12*a–d* of a high-index material, for example titanium dioxide. The first interference layer being provided on the particles of the first particle group, the second interference layer being provided on the particles of the second particle group, the third interference layer being provided on the particles of the third particle group, and so on. Said interference layers all being mutually different. For the sake of clarity, the four differently colored particle groups are represented in the drawing by markings in the core 11, respectively no marking, ×, – and •. The particles 10*a–d* exhibit respectively a platinum-gold, red, blue and green color due to the mutually different interference layer 12*a–d*, for example Iriodin 205 (platinum gold), 211 (red), 221 (blue), 231 (green) and are intermixed present in the coating 5 yielding the coating to exhibit a white color. The coating 5 is provided on the diffusor 3 by means of spraying of a suspension comprising a binder, for example THV200 or silicon lacquers or silica-based sol-gel systems, and the colored particle groups in a solution, for example methyl-isobutyl-ketone. The amount of solid in the eventually obtained dried layer is preferably 10–30% by volume, i.e. 23% by volume in the given example.

Figure 4:
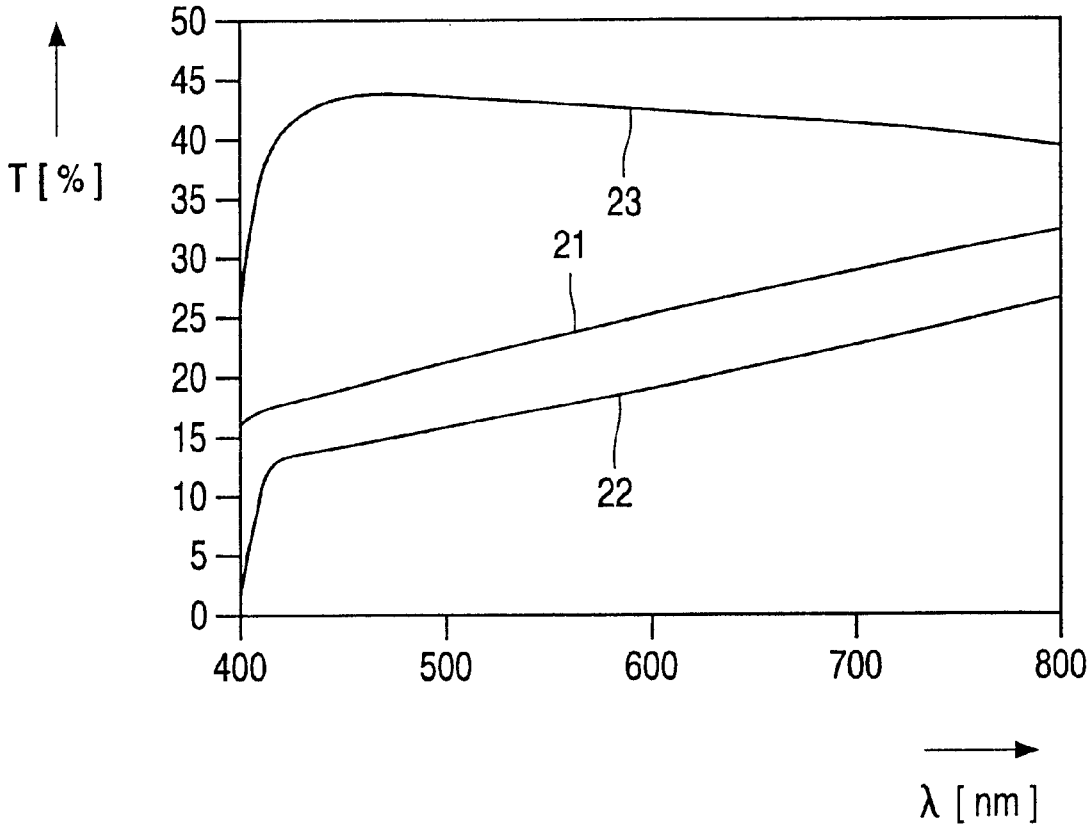
FIG. 4 is a graph showing the transmission T versus the wavelength λ of an interference coating as used in a luminaire according to the invention.

FIG. 4 shows a transmission spectrum of a coating of a mixture 23 of five differently colored particle groups, compared to transmission spectra of corresponding anatase 21 and rutile coating 22, which are both crystal modifications of titanium dioxide. The five different particle groups in the mixture coating 23 are Iriodin 28% 201 (gold), 7% 205 (platinum gold), 23% 211 (red), 21% 221 (blue), and 21% 231 (green), all percentages by weight. The respective particle size ranges of the particle groups are Iriodin 201 (gold) 5–25 μm, 205 (platinum gold) 10–60 μm, 211 (red) 5–25 μm, 221 (blue) 5–25 μm, and 231 (green) 5–25 μm. In table 1 CIELAB color shifts Δa and Δb of the coating 21, 22, and 23 with respect to a standard known under the trade name Spectralon, the reflectance R, coating thickness C and a measure of the reflection power R/G of the coatings 21, 22, and 23 are given. Table 1 shows that the mixture 23 has a color shift which is satisfactorily small and which is much smaller than the color shifts of anatase and rutile.

TABLE 1

| | Δa | Δb | R[%] | C[μm] | R/C[%/μm] |
|---|---|---|---|---|---|
| Anatase 21 | 1.8 | 7.8 | 63 | 9 | 7 |
| Rutile 22 | 2.2 | 7.4 | 74 | 9 | 8 |
| Mixture 23 | −1.2 | 0.2 | 47 | 12 | 4 |

As is shown in FIG. 4 this color shift is due to the transmission of the coating being dependent on the wavelength which is explainable by wavelength dependent scattering of the anatase 21 and rutile coating 22. This wavelength dependent scattering is practically absent in the case of the coating of the mixture 23. The reflection power RIG of the mixture 23 is less than those of anatase 21 and rutile 22, however, it is apparent from FIG. 4 and table 1 that the combination of said five particle groups surprisingly yields the white color impression of the coating mixture 23.

What is claimed is:

1. A luminaire (1) comprising:

a reflector body (9) having a reflective part (2) provided with a coating (5), the coating (5) comprising at least one material selected from a set consisting of materials with a high-index of refraction and at least one further material selected from a further set consisting of materials with a low-index of refraction; and contact means (6) for electrically connecting a light source, arranged such that light from the source will impinge on said coating, characterized in that the coating (5) comprises at least a first group of light reflective particles of a first color and a second group of light reflective particles of a second color different from said first color, the particles of the first particle group each comprising a core material selected from one of said sets, and being provided with a respective first interference layer of a material selected from the other of said sets, the particles of the second particle group each comprising a core material selected from a first of said sets and being provided with a respective second interference layer of a material selected from the second of said sets, the respective second interference layers being different from the respective first interference layers, and relative quantities of each respective light reflective particle group being chosen such, that when their reflections are blended, there is produced white light of predetermined CIE coordinates.

2. A luminaire (1) according to claim 1, characterized in that each particle of one of the particle groups is provided with a respective interference layer.

3. A luminaire (1) according to claim 1, characterized in that the coating (5) comprises two particle groups, the respective particle groups exhibiting respectively a blue and a gold color.

4. A luminaire (1) according to claim 1, characterized in that the coating (5) comprises three particle groups, the respective particle groups exhibiting respectively a blue, a green and a red color.

5. A luminaire (1) according to claim 1, characterized in that the coating (5) comprises four particle groups, the respective particle groups exhibiting respectively a blue, green, red and platinum-gold color.

6. A luminaire (1) according to claim 1, characterized in that the coating (5) comprises five particle groups, the respective particle groups exhibiting respectively a blue, green, red, gold and platinum-gold color.

7. A luminaire (1) according to claim 1 characterized in that in the coating (5) the particles (10*a–d*) of said particle groups are mixed.

8. A luminaire (1) according to claim 1 characterized in that the particles (10*a–d*) have a particle size of at least 5 $\mu$m.

9. A luminaire (1) according to claim 1 characterized in that the luminaire is a backlighting system.

10. A luminaire (1) according to claim 1, characterized in that said respective second interference layers have a thickness different from the thickness of the respective first interference layers.

11. A luminaire (1) according to claim 1, characterized in that said respective second interference layers are a material different from the material of the respective first interference layers.

12. A luminaire (1) according to claim 1, characterized in that said contact means comprises a contact means comprises a contact for a low pressure mercury discharge fluorescent lamp.

13. A luminaire (1) according to claim 12, characterized in that the luminaire further comprises a low pressure mercury discharge fluorescent lamp.

* * * * *